US005562443A

United States Patent [19]

Trelby

[11] Patent Number: 5,562,443

[45] Date of Patent: Oct. 8, 1996

[54] ROTATABLE COOLER FOR A ROTARY KILN PLANT

[75] Inventor: Ib V. Trelby, Valby, Denmark

[73] Assignee: F. L. Smidth & Co. A/S, Denmark

[21] Appl. No.: 416,724

[22] PCT Filed: Nov. 10, 1993

[86] PCT No.: PCT/DK93/00368

§ 371 Date: Apr. 11, 1995

§ 102(e) Date: Apr. 11, 1995

[87] PCT Pub. No.: WO94/11690

PCT Pub. Date: May 26, 1994

[30] Foreign Application Priority Data

Nov. 12, 1992 [DK] Denmark ..... 1373/92

[51] Int. Cl.[6] ..... F27D 15/02

[52] U.S. Cl. ..... 432/80; 432/106

[58] Field of Search ..... 432/80–82, 106

[56] References Cited

U.S. PATENT DOCUMENTS

| | | | |
|---|---|---|---|
| 1,404,381 | 1/1922 | Fasting | 432/80 |
| 1,690,048 | 10/1928 | Bentley | 432/80 |
| 2,001,258 | 5/1935 | Lindhard | 432/80 |
| 2,019,179 | 10/1935 | Fasting | 432/80 |
| 3,824,069 | 7/1974 | Brachthauser et al. | 432/85 |
| 3,891,383 | 6/1975 | Kobayashi | 432/106 |
| 4,089,634 | 5/1978 | Sylvest | 432/80 |

*Primary Examiner*—Andrew M. Dolinar

*Attorney, Agent, or Firm*—Brumbaugh, Graves, Donohue & Raymond

[57] ABSTRACT

A cooler (6) for cooling of particulate material which is subjected to heat treatment in the rotary kiln is mounted at the material outlet end (1) of a rotary kiln. The cooler is provided with annular chambers (7, 8, 9) disposed around each other, and which are successively passed by the material from the outlet (5) of the kiln to a material outlet (20) in the stationary housing (15) of the cooler in countercurrent with the cooling air which flows from an air inlet (18) and through the annular chambers to the kiln in which the air thus heated is utilized as combustion air.

5 Claims, 2 Drawing Sheets

ROTATABLE COOLER FOR A ROTARY KILN PLANT

Figure 1:
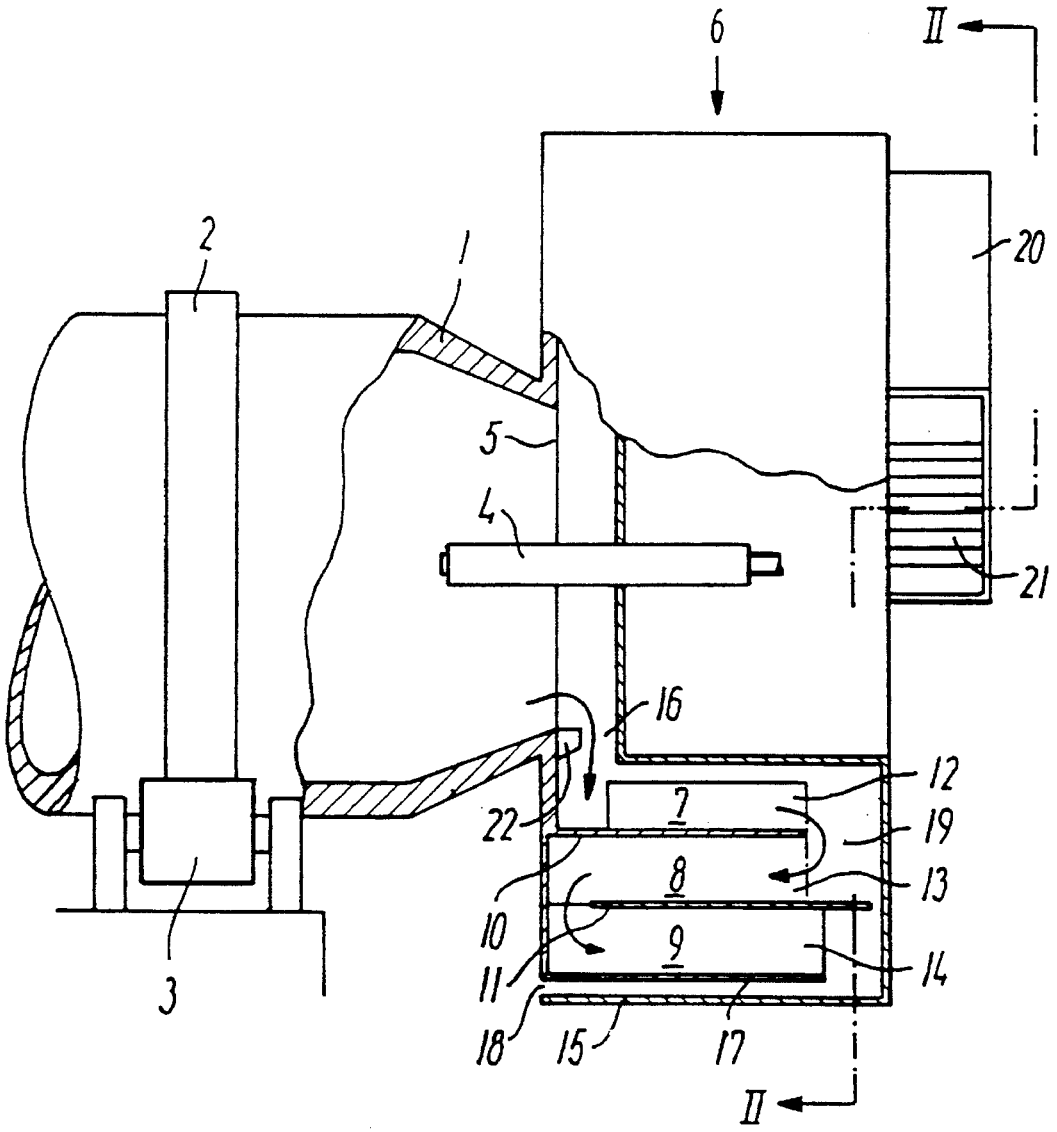

The invention relates to a rotatable cooler for air cooling of particulate material subsequent to its heat treatment in a rotary kiln, the cooler being mounted on the outlet end of the kiln and comprising several chambers which are parallel to the kiln axis and through which the material can be conducted in counter-current with the cooling air, said chambers being surrounded by a stationary housing.

Coolers of the above-mentioned kind are known inter alia as so-called satellite coolers, for example from the description to British Patent No. 1365171. Such satellite coolers are very effective for cooling of for example cement clinker after burning and areas of application include high-capacity plants.

However, a satellite cooler is rather voluminous and expensive to manufacture and particularly difficult to install on existing kilns not already equipped with a cooler of this type.

It is the object of the present invention to provide a cooler which is both economical to manufacture and of a compact design, and which can be installed on rotary kilns without any major difficulties.

According to the invention this is achieved by a cooler of the kind mentioned in the introduction, being characterized in that the chambers are annular chambers disposed around each other, being inter-coaxial and coaxial with the kiln, and fixed to and protruding away from the material outlet end of the kiln, that the chambers are divided into longitudinal ducts by means of partitions and guide vanes for conveying the material successively through the annular chambers, that the inlet of the innermost annular chamber is connected to the kiln outlet via an annular gap between the cooler housing and the kiln end, that each chamber placed between the innermost and the outermost annular chamber has its inlet connected to the outlet of the immediately preceding annular chamber and its outlet connected to the inlet of the immediately surrounding annular chamber, and that the material outlet of the outermost annular chamber is connected to the cooler inlet for cooling air.

The burner for heat treatment of the material in a rotary kiln is normally fitted in the material outlet end of the kiln. The burner is supplied with combustion air, which is preheated in the cooler, and this airstream enters through the above-mentioned annular gap, thus ensuring that the air is effectively distributed around the burner.

Given that the burner is fitted in such a way that it protrudes away from the kiln end, it is possible to support the kiln very close to its outlet end and to achieve more effective cooling of this end by the ambient air. Further, the condition of the thermal zone of the kiln can be monitored more effectively, for example by means of infrared measurements.

The internally fitted partitions and guide vanes inside the annular chambers provide a wide range of options for discharging the finish-cooled materials from the cooler, and, therefore, the cooler housing may have a material outlet which is connected to the material outlet of the outermost annular chamber, and which is located at that part of the annular chamber being the uppermost at any time.

With the material outlet being placed at such a high level, it is possible to attain a low building height for the entire kiln installation and also to obtain space for equipping the material outlet of the cooler housing with a material chute having at least one grate for separating the cooled material into particle size fractions.

In order to disintegrate oversize lumps of material which may get stuck in the annular gap, thus causing stoppage and wear, material disintegration means may be fitted in the annular or inlet gap of the cooler.

The inlet for cooling air to the cooler may advantageously be formed by an annular air gap between cooler housing and the outermost annular chamber.

Since the different annular chambers are heated to different temperatures, it is advantageous that the annular chambers are connected to one another and to the housing with due allowance for expansion, for example by means of sliding guides and laminated seals.

Figure 2:
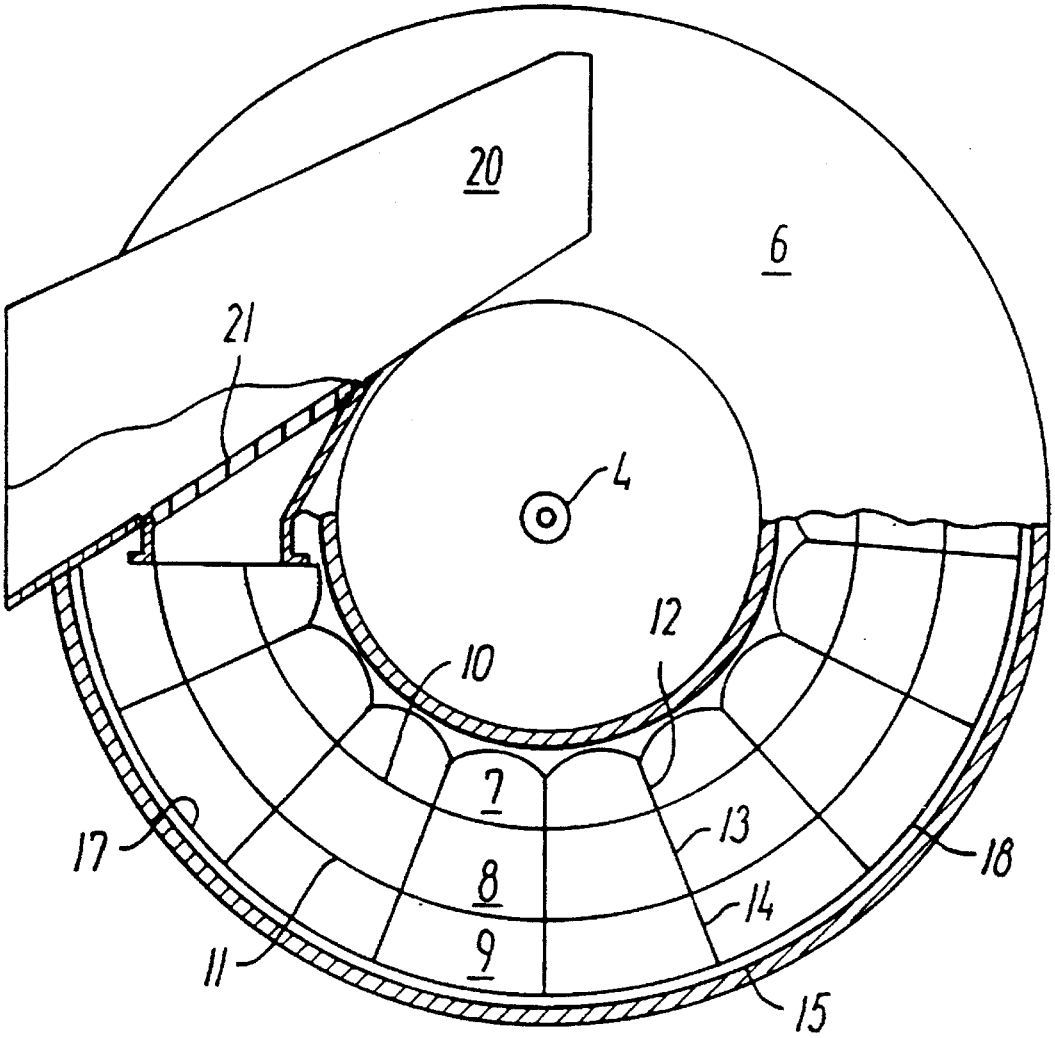

The invention will now be described in further details by means of an embodiment of a cooler according to the invention and with reference to the accompanying drawing, being diagrammatical, and where FIG. 1 shows a side view, partly in sectional cut, of a cooler according to the invention, and FIG. 2 shows a section according to the line II—II in FIG. 1

In FIG. 1 is shown the outlet end 1 of a rotary kiln which is supported via a live ring 2 on a roller support 3. The material subjected to heat treatment in the kiln is heated by means of a burner 4, whereas the material is conveyed through the kiln in known manner and discharged at the kiln outlet 5.

On the outlet of the kiln is mounted a cooler 6 comprising several annular chambers, on the drawing three chambers 7, 8, 9, which are individually separated by means of cylindrical walls 10 and 11. The annular chambers are divided into longitudinal ducts by means of partition walls 12, 13, 14, which also operate as guide vanes. The rotatable annular chambers are surrounded by a stationary housing 15, which, inside the innermost annular chamber 7, is protruding towards the kiln outlet 5 where in conjunction with the latter it forms an annular gap 16, and which together with the outer wall 17 of the outermost annular chamber forms an air inlet gap 18 for supply of cooling air to the cooler.

The operating principle of the cooler is as follows:

The material to be cooled in the cooler is conveyed from the kiln outlet 5, via the annular gap 16, into and through the innermost annular chamber 7 to the outlet 19 of the latter, which outlet simultaneously constitutes the inlet for the intermediate annular chamber 8 and onward through the intermediate annular chamber 8 and the outermost annular chamber 9 from which the material is discharged by means of the partition walls and the guide vanes 14 through a material outlet 20 which is located in the upper section of the cooler housing.

Cooling air is sucked in through the gap 18 between the outermost annular chamber wall 17 and the cooler housing 15 and the air is conveyed, counter-current to the material stream, from the outermost to the innermost annular chamber and onward via the annular gap 16 into the kiln end, in which the now heated cooling air is utilized as combustion air for the burner 4.

In the material outlet 20 from the cooler housing 15 a grate 21 may be fitted at the bottom of the outlet applicable for a separation of the finish-cooled material according to particle sizes.

Further, as indicated at 22, certain impacting devices may be installed on the rotating kiln end in the annular gap 16, and these devices are used to disintegrate lumps of material which are too large to pass through the annular gap 16, and which also would reduce the cooling efficiency of the material in the cooler 6.

I claim:

1. A cooler adapted for being arranged at an outlet end of a rotary kiln having a material inlet end and a material outlet end to serve the purpose of air cooling particulate material subsequent to its heat treatment in the kiln, said cooler comprising annular coaxial chambers communicating to form a path for conducting the particulate material through the cooler in counter-current with a cooling air stream, wherein said cooler comprises a stationary portion comprising a stationary housing and a rotatable portion surrounded by the stationary housing and comprising a set of annular chambers disposed coaxially around each other and adapted for being mounted at the outlet end of the kiln coaxially with the kiln, said cooler being mounted at the outlet end of the kiln such that it extends beyond the outlet end and thus does not substantially overlap the outer surface of the outlet end, said annular chambers being divided into longitudinal ducts by means of partitions and guide vanes, the set of annular chambers comprising at least an innermost chamber, an intermediate chamber and an outermost chamber, the innermost chamber having an inlet communicating with the kiln outlet through an annular gap between the stationary housing and the kiln outlet end, in that each duct within the intermediate chamber has an inlet communicating with the outlet of a duct within the immediately preceding annular chamber and an outlet communicating with an inlet of the immediately surrounding outermost chamber to form a path for conveying the material successively through the annular chambers, and in that the outermost chamber comprises an inlet for the introduction of cooling air.

2. A cooler according to claim 1, wherein the stationary housing has a material outlet (20) in the upper section of the stationary housing which is connected to the material outlet of the outermost annular chamber (9) so that material may be discharged from that part of the annular chamber which the uppermost one at any time.

3. A cooler according to claim 2, wherein the material outlet (20) of the cooler housing comprises a material chute having at least one grate (21) for separating the cooled material into particle size fractions.

4. A cooler according to claim 1, wherein material disintegration means (22) are fitted in the annular gap (16) of the cooler (6).

5. A cooler according to any one of the preceding claims, whereinin the cooling air inlet is formed by an annular air gap (18) between the stationary housing (15) and the outermost annular chamber (9).

* * * * *